US005709061A

United States Patent [19]

Dietrich

[11] Patent Number: 5,709,061

[45] Date of Patent: Jan. 20, 1998

[54] STRUCTURAL CONNECTOR FOR A SANDWICH CONSTRUCTION UNIT

[75] Inventor: Douglas D. Dietrich, Ankeny, Iowa

[73] Assignee: Iowa State University Research Foundation, Inc., Ames, Iowa

[21] Appl. No.: 663,852

[22] Filed: Jun. 19, 1996

Related U.S. Application Data

[63] Continuation of Ser. No. 266,528, Jun. 28, 1994, abandoned.

[51] Int. Cl.[6] ..... F04B 2/00

[52] U.S. Cl. ..... 52/426; 52/405.1; 52/435; 52/562

[58] Field of Search ..... 52/309.9, 309.12, 52/309.11, 405.1, 407.1, 435, 439, 425–426, 562, 564, 568, 481.1

[56] References Cited

U.S. PATENT DOCUMENTS

| | | | |
|---|---|---|---|
| 2,318,820 | 5/1943 | Voigt et al. | 52/407.1 X |
| 2,634,601 | 4/1953 | Tillery | 52/405.1 X |
| 4,054,710 | 10/1977 | Botsolas | 52/309.9 X |
| 4,263,765 | 4/1981 | Maloney | 52/405.1 X |
| 4,604,843 | 8/1986 | Ott et al. | 52/309.9 X |
| 4,745,720 | 5/1988 | Taylor | 52/405.1 |
| 4,802,318 | 2/1989 | Snitovski | 52/405.1 X |
| 4,829,733 | 5/1989 | Long . | |
| 5,193,320 | 3/1993 | Coccagna | 52/442 |
| 5,203,132 | 4/1993 | Smolik | 52/241 |
| 5,305,567 | 4/1994 | Wittler | 52/243.1 X |
| 5,311,718 | 5/1994 | Tronsilek | 52/439 X |
| 5,459,971 | 10/1995 | Sparkman | 52/426 |

*Primary Examiner*—Carl D. Friedman
*Assistant Examiner*—Winnie Yip
*Attorney, Agent, or Firm*—Henderson & Sturm

[57] ABSTRACT

A structural connector for a sandwich construction unit. The connector is made of material having a low heat conductance such as a fiber-composite material. The connector extends between two parallel spaced panels and also extends the entire length of the panels between structural members such as a floor and a ceiling. The edges of the connector are attached to the panels by suitable means such as a fluid bonding material.

20 Claims, 3 Drawing Sheets

STRUCTURAL CONNECTOR FOR A SANDWICH CONSTRUCTION UNIT

RELATED APPLICATIONS

This application is a continuation of U.S. patent application Ser. No. 08/266,528, filed Jun. 28, 1994, now abandoned.

This invention relates to wall constructions, and more particularly to a structural connector for a sandwich construction unit.

BACKGROUND ART

Masonry construction has improved greatly through the use of new materials and modern fabrication techniques. Substantially increased strength, thermal properties, and reduced weight have occurred through the use of cavity wall construction along with composite materials resulting in lighter and more energy efficient wall assemblies.

There are many architectural design advantages to using composite concrete masonry cavity wall systems. The exterior wythe of concrete can be treated in various manners to give texture and color to the building facade. The concrete can be raked to give a coarse texture or sandblasted to reveal the natural beauty of the concrete or aggregates can be incorporated into the concrete mix to provide color and texture to the wall. Several manufacturers also produce specialty architectural block which have ridges and reveals in the block face. The possibility of great number/of architectural block designs allows concrete masonry walls to be used in many architectural concepts.

The increasing costs of natural resources and labor have prompted architects to investigate construction techniques and building systems that produce more energy-efficient and cost-effective structures. Increasing fuel costs have provided the incentive to construct increasingly comfortable and energy-efficient living environments by utilizing insulated concrete masonry cavity wall construction.

A typical insulated concrete masonry wall consists of two layers or wythes. The outer wythe is placed with an insulation core between it and the interior wythe. Interior and exterior wythes are attached to each other through the use of connectors and act as one wall or as a composite wall construction. In single wythe construction, one concrete masonry unit (CMU) wide, a solid concrete web the width of the block is utilized as the connector between the interior and the exterior face of the block. Several different connector schemes are used. Generally, most systems have relied upon a solid concrete web in one wythe construction and mild or stainless steel connectors in multi-wythe construction.

Some form of mechanical connectors or solid concrete web is required to transfer forces between the concrete wythes, but because the concrete or steel connectors have a high thermal conductivity, the overall thermal efficiency of the wall is reduced. Past research has shown the reduction in thermal efficiency can be significant because of concrete and steel thermal bridges.

Thermal requirements have led in more recent years to the use of nonmetallic fiber-reinforced composite plastic connectors. During the past years, great advancements have been made in the general use of fiber composite plastics (FCP). FCP offers many advantages over traditional construction building materials because FCP has high tensile strength, light weight, and low thermal conductivity. Insulated CMU walls, incorporating the use of FCP components will undoubtedly provide an increase in thermal efficiency and thereby reduce energy costs in residential CMU systems.

Insulated CMU walls are presently used in a limited variety of residential construction techniques. CMU's are generally manufactured at a pre-casting facility and transported to the construction site. Walls vary in height from as little as 8 ft. for basements to over 35 ft. for reinforced walls with concrete wythe to 12 in. for a structural wythe. In addition, several differing insulation types, densities, and thicknesses are commonly used.

Design loads depend upon wall type, use, and construction techniques. Walls may resist axial loads and act as beam-columns or be non-load-bearing and resist only lateral forces. Present design of CMU cavity walls generally assumes that the inner structural wythe resists axial loads, whereas both wythes resist lateral loads. When CMU walls are used in earthquake regions, both the concrete and the connectors must provide sufficient strength and ductility to resist stresses induced during the earthquake loadings.

The thermal resistance is one of the primary advantages of composite concrete masonry cavity wall construction. Concrete has a low thermal resistance which is limited to use in energy efficient structures. By placing a core of insulation between two concrete wythes, the thermal resistance of the wall section can be greatly improved. The designer can obtain the beauty and simplicity of both an exterior and interior concrete surface while not sacrificing the thermal resistance of the building. The architect can use the structural capacity of the concrete masonry while not having to provide extra fire protection for the insulation or connector. The thermal resistance of the wall section can be increased by providing a core material with a higher thermal resistance or increasing the thickness of the insulation in the core. Present design and construction of the insulated cavity CMU wall assemblies focuses on the use of metal connectors to attach the exterior and interior wythes.

The calculation of the R-value of concrete masonry wall is produced by two methods. The first method is referred to as a straight or series path method. The thermal resistance of the wall section is calculated by adding the individual resistance values of the materials used in the wall panel. A typical R-value calculation for a wall section using the series heat flow method would be conducted by adding the resistance value of the exterior and interior wythes of concrete masonry to the resistance value of the insulation. The total R-value of the concrete masonry cavity wall would include the total of the resistance values plus interior and exterior air film R-values.

A comparison of thermal test results to the series heat flow calculations show that this method is an upper bound of the true R-value. When concrete or metal ties cross the insulation barrier, a thermal bridge is created and the R-value of the wall section is reduced. Since all concrete masonry cavity walls has some method of connecting the concrete wythes together, the second method-the parallel heat flow method, or isothermal planes method—is frequently used to estimate the true R-value of the wall section. Table I below shows the thermal properties of selected materials.

TABLE 1

Thermal properties of materials used in isothermal plane calculations.

| Item | Conductivity Btu* in./hr* ft$^{2*}$ F. |
|---|---|
| Concrete | 16.0 |
| Insulation | |
| Extruded | 0.215 |
| 2-lb EPS | 0.230 |
| 1–16 EPS | 0.260 |
| Connectors | |
| Fiber-composite | 2.1 |
| Stainless steel | 185 |
| Mild Steel | 365 |

The isothermal planes method is used when relatively small cross sections of a higher conductance level pass through the insulation barrier. The method assumes that the heat flow tends to become attracted to the materials with a higher conductance, and thus, the heat flows in a lateral motion along the concrete wythes. The heat then flows or bridges through the path of least resistance, which is through the concrete or metal bridging. This phenomenon allows the heat to escape to the exterior wythe of concrete and thus a lower R-value is realized. The isothermal planes method calculates a R-value which is generally accepted as a lower bound. The actual R-value generally falls between the values calculated by the straight path and parallel series path methods.

Those concerned with these and other problems recognize the need for an improved structural connector for a sandwich construction unit.

DISCLOSURE OF THE INVENTION

The present invention provides a structural connector for a sandwich construction unit. The connector is made of material having a low heat conductance such as a fiber-composite material. The connector extends between two parallel spaced panels and also extends the entire length of the panels between structural members such as a floor and a ceiling. The edges of the connector are attached to the panels by suitable means such as a fluid bonding material.

An object of the present invention is the provision of an improved structural connector for a sandwich construction unit.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
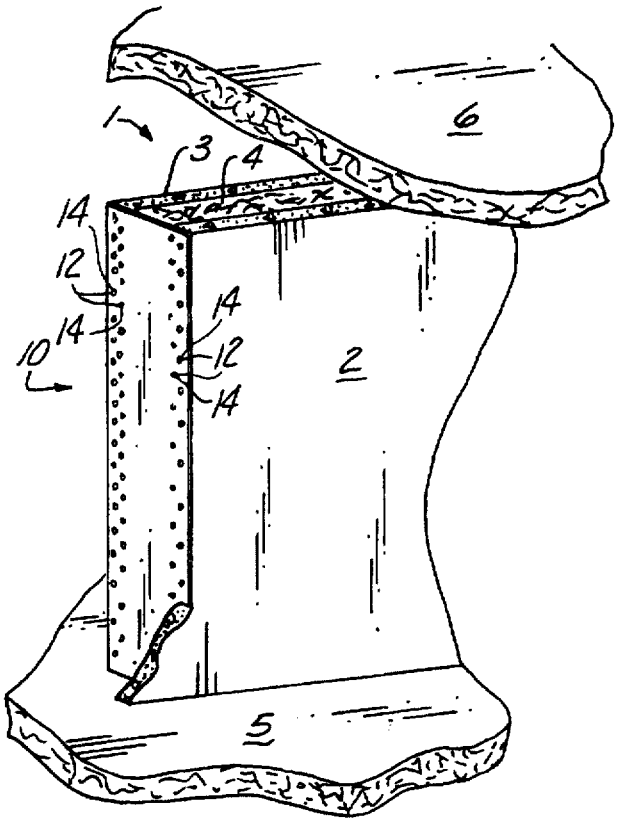
FIG. 1 is a perspective view of an insulated sandwich construction unit where the panels are formed of poured concrete portions being cut away to show the components of the unit.

Fiber-reinforced composite materials are very versatile due to the wide range of fibers and matrix materials that can be combined to form composite materials. Among fiber composites GRP (glass fiber-reinforced plastics) and GRC (glass fiber-reinforced cement) have been used in buildings. Other fiber composites are very expensive to be used in buildings. GRC has been used as cladding panels, lintels, sun screens, internal partitions, conduit linings, sandwich panels, floating pontoons, low pressure pipes, fire doors, sheds, garages and bus shelters.

The advances made during recent decades have increased the possibilities of using plastic materials in architectural situations. The matrix provides the basic form, transfers stresses to the fibers, and enables the fibers to resist compression forces. In addition to the fibers and the resin, small quantities of nonstructural materials, such as pigments and fillers, may be present in the composite material. Fibers may have any number of orientations from random, multi-directional and uni-directional in single or multiple layers. Fibers may be of various materials. The most common fibers are glass, boron, graphite and Kelvar. Fiber lengths vary from continuous to short, chopped segments. Resins also vary widely with thermoset polyesters and vinyl esters commonly being used. New fibers and resins are continually being developed. Production techniques are vastly different, and methods range from molding, hand lay-up, and filament winding to pultrusion. Each method had its unique advantages and disadvantages. Production rates, the ability to produce variable cross sections, and the maximum size also affect selection of a fabrication technique.

Glass fibers, because of the low cost and high strength, are frequently combined with the pultrusion process to produce structural plastics. The pultrusion process can be used to manufacture a fiber composite web with a constant cross section. The pultrusion process includes: (1) impregnation of reinforcing fibers by liquid resin, (2) consolidation to remove air and excess resin, (3) shaping and curing in a mold, and (4) demolding and finishing. These steps are combined in a continuous process as the fibers are passed through a resin or epoxy, pulled through a heated die, and shaped in the form of the desired product. Temperature and pulling rate are critical to the curing process as the fibers pass through the die. The required pulling force increases with higher fiber percentages as well as with increased cross-sectional dimensions. Cross-sectional dimensions are frequently limited by available pulling force.

Glass percentages vary from 50% to 75% (by weight). Higher fiber percentages improve stiffness characteristics at the expense of increased glass and manufacturing costs. The glass-fiber pultruded products that are produced include many structural shapes: for example, rods, bars, channels, tubes, and wide flange shapes. In addition, FRP (fiber reinforced plastics) bolts and nuts are available to connect these members. Structural shapes and grating (grided shapes) manufactured with the pultrusion process can be used in a variety of applications where extreme corrosive environments are present. Shapes are generally thin with a maximum depth of wide flange shapes is approximately 12 in. because of pulling force requirements as well as curing needs.

Several types of glass (A-glass, AR-glass, S-glass, and E-glass) are commonly used to produce pultruded FCP. Borosilicate glass (E-glass) is the most popular because of its low cost and wide availability. It is produced as a single filament, continuous strand that is designed for reinforcing. Diameters range from $20\times10^{-5}$ in. to $100\times10^{-5}$ in. with virgin strengths reported at 500,000 psi., with the actual strength at time of incorporation into the composite is on the order of 300,000 psi. The modulus of elasticity of E-glass is approximately 10,500,000 psi.

Resins and epoxies forming the matrix serve the important function of transmitting the stress to the fibers and protecting the fibers from the environment. Economy and workability have made polyester the primary resin used with the pultrusion process. Polyesters cure rapidly; this makes them particularly attractive to higher production rates.

The connectors for the system are made of glass fiber material stock manufactured using a pultrusion process and have a sectional configuration of various designs as illustrated in the drawings. The glass fiber materials are passed through a resin dip tank and then pulled through a heated die. E-glass, a borosilicate glass, is used due to its high strength. The virgin tensile strength of E-glass is 500,000 pounds per square inch (psi) and has a modulus elasticity at 72° F. of 10,500,000 psi. The material stock generally contains 70% E-glass and 30% resin matrix composed of resin, filler, and mold lubricant as specified by the manufacturer. The resin material bonds the glass together and allows the transfer of stress between the fibers. The filler is an inert material which is added to modify the properties of the connectors. Mold lubricant is added to allow efficient flow of the material through the die.

Figure 2:
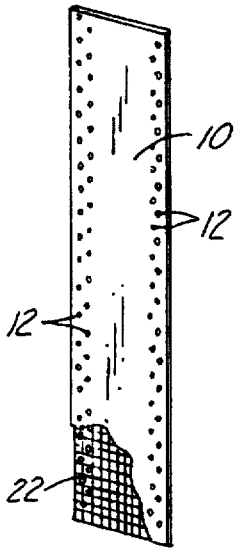
FIG. 2 is a perspective view of a continuous flat sheet of composite material with portions cut away to reveal the mesh base.
Figure 3:
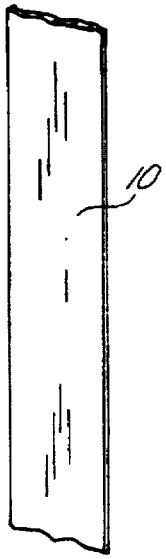
FIG. 3 is a perspective view similar to FIG. 2 but showing a continuous corrugated sheet of composite material.
Figure 4:
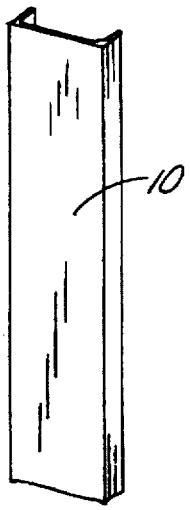
FIG. 4 is a perspective view showing a continuous channel-shape sheet of composite material.
Figure 5:
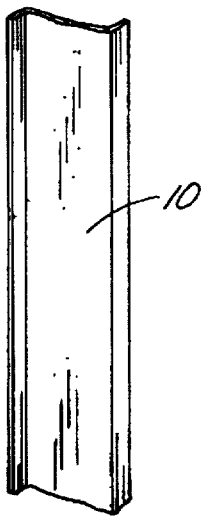
FIG. 5 is a perspective view showing a continuous Z-shaped sheet of composite material.
Figure 6:
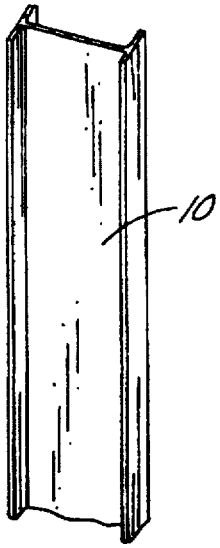
FIG. 6 is a perspective view showing a continuous I-shaped sheet of composite material.

Referring now to the drawings, wherein like reference numerals designate identical or corresponding parts throughout the several views, FIG. 1 shows a sandwich wall unit (1) having poured concrete wall panels (2 and 3) separated by a layer of insulating material (4). The wall panels extend between a floor member (5) and a ceiling member (6) and are connected by the vertical structural connector (10) of the present invention. The connector (10) illustrated in FIGS. 1 and 2 is a flat sheet of low-heat conducting material having a plurality of apertures (12) formed along the edges. A fluid bonding material (14), such as grout, motor, or concrete, is received in the apertures (12), and upon setting up hold the connector (10) and prevents its lateral movement. FIGS. 3–6 illustrate alternate shapes for the connectors (10).

Figure 7:
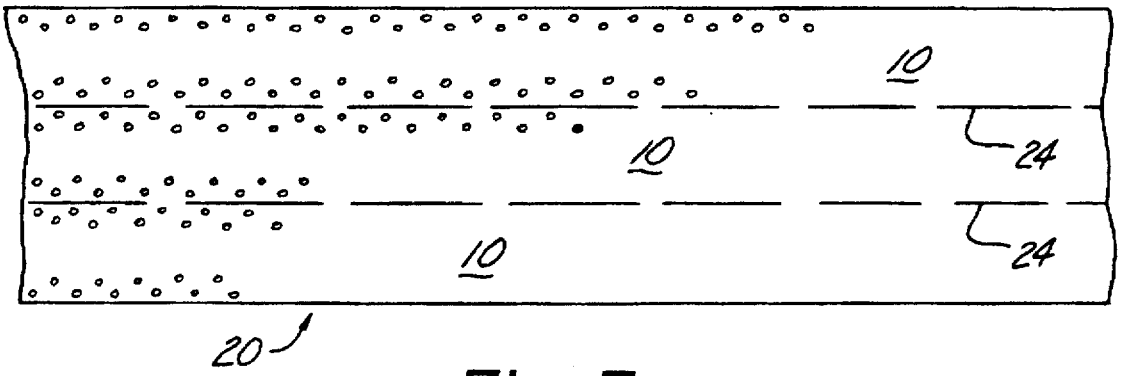
FIG. 7 is a plan view of a flat sheet of composite material similar to FIG. 2 but being formed in a wide sheet from which several flat structural connectors can be cut.

FIG. 7 illustrates a continuous flat sheet (20) of composite material formed by the pultrusion process. The composite material includes a mesh base (22) upon which a plastic material is supported. Also, the sheet (20) is formed in a large width from which several connectors (10) may be cut, as for example, along pre-marked lines (24). It is to be understood that the connectors (10) of the various shapes showing in FIGS. 3–6 could also be cut from larger sheets of material.

Figure 8:
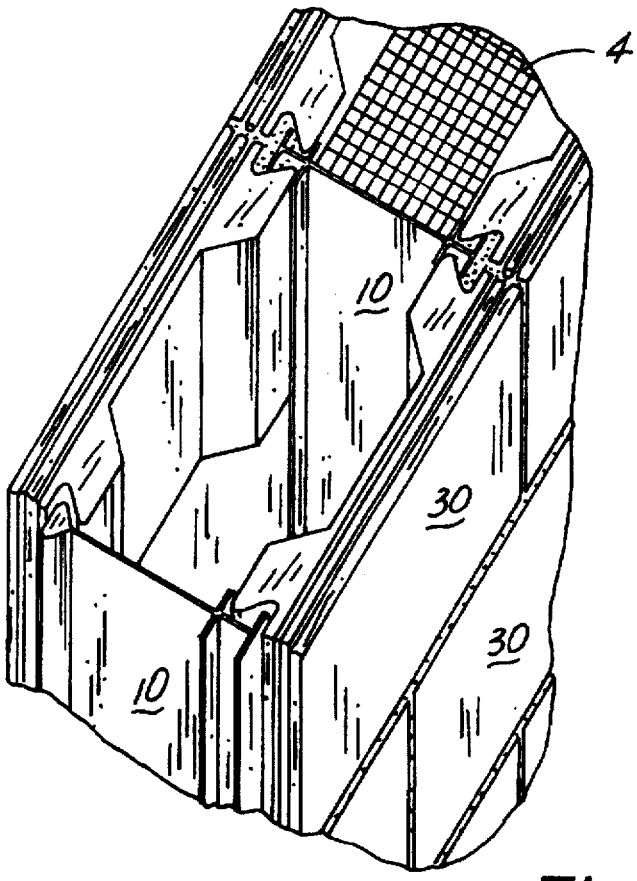
FIG. 8 is a perspective view of a portion of a masonry block wall using a structural connector.
Figure 9:
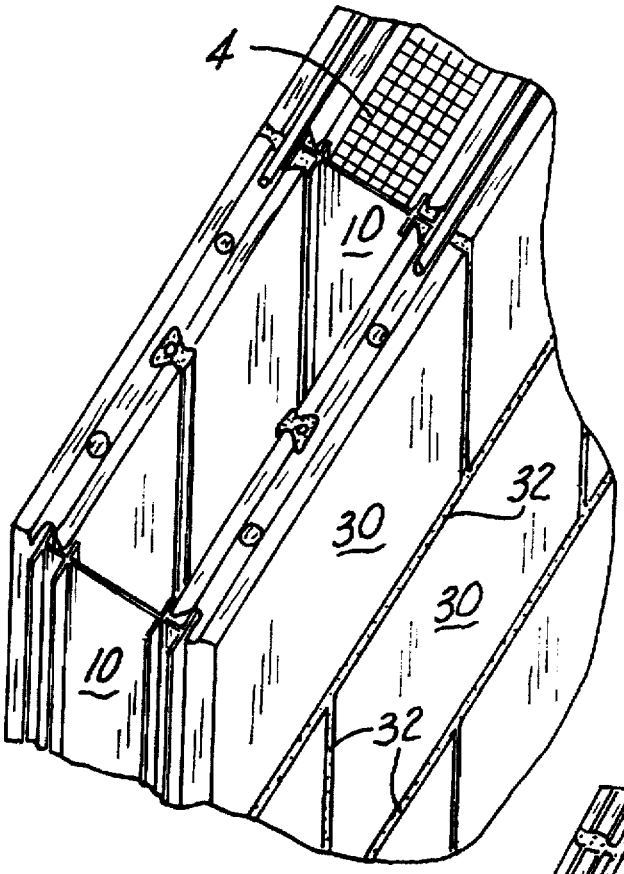
FIG. 9 is a perspective view similar to FIG. 8 but showing an alternate masonry block system and an alternate shaped connector.
Figure 10:
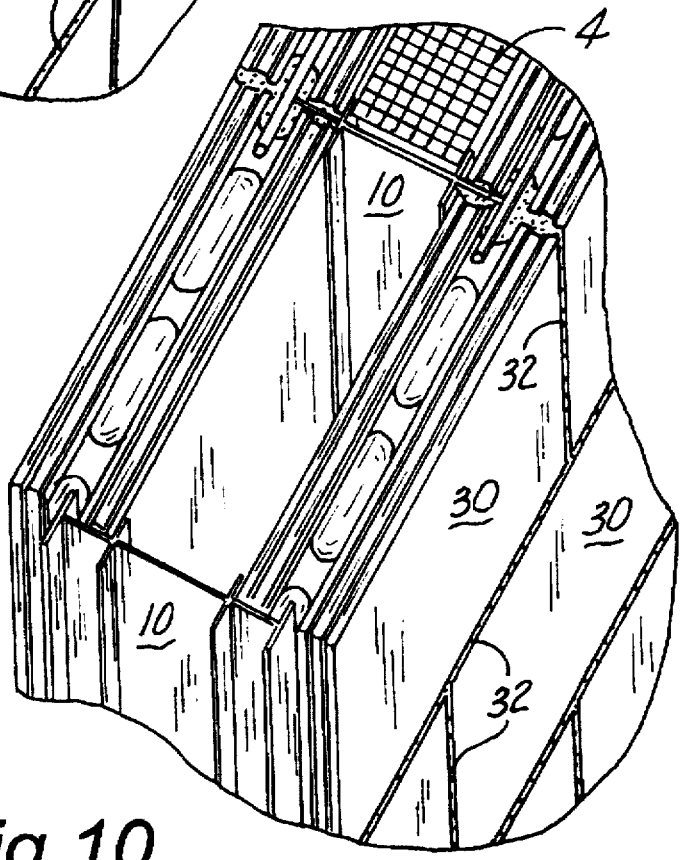
FIG. 10 is a perspective view showing yet another masonry block system.

FIGS. 8–10 illustrates connectors (10) of various shapes used in masonry block wall constructions. The blocks (30) may be formed of various materials such as concrete, fiber, and glass. The blocks (30) are secured in position by a suitable bonding material (32) such as grout, mortar or concrete.

In all embodiments, the structural connector (10) is formed of a material having a low heat conductivity, preferably in the range of 2–3 Btu. in./hr.ft$^2$.F. Also, each connector (10) extends the entire distance between the floor (5) and ceiling (6) to assist in providing structural integrity for the sandwich wall unit (1).

This, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. In an insulated sandwich construction unit, including a first concrete panel disposed to extend between a floor member and a ceiling member, a second concrete panel disposed in parallel spaced relationship to the first panel to extend between the floor and ceiling members, and insulating material disposed intermediate the first and second panels, the improvement comprising:

a continuous, rigid, one piece, vertical, load-transferring, structural connector formed of a continuous pultruded resin impregnated glass fiber material dissimilar to the concrete panels and having a low heat conductivity extending perpendicular to the first and second concrete panels the entire distance between the floor and ceiling structural members, the structural connector including a first edge attached to one end of the first panel and a second opposite edge attached to one end of the second panel; and means for attaching the first and second edges of the structural connector to the said one ends of the first and second panels.

2. The insulated sandwich construction unit of claim 1 wherein the first and second panels are formed of poured concrete.

3. The insulate sandwich construction unit of claim 1 wherein the first and second panels are formed of a plurality of concrete blocks secured in position by a bonding material.

4. The insulated sandwich construction unit of claim 3 wherein the bonding material is selected from a group consisting of grout, mortar, and concrete.

5. The insulate sandwich construction unit of claim 1 wherein the structural connector is a flat sheet, and wherein the attaching means includes a plurality of apertures formed near the first and second edges, the apertures being disposed in direct communication with a portion of the first and second concrete panels to receive a fluid bonding material.

6. The insulate sandwich construction unit of claim 5 wherein the flat sheet is cut from a larger pultruded sheet of resin impregnated glass fiber material.

7. The insulated sandwich construction unit of claim wherein the fluid bonding material is selected from a group consisting of grout, mortar, and concrete.

8. The insulate sandwich construction unit of claim 1 wherein the structural connector is a corrugated sheet having vertically disposed corrugations formed near the first and second edges, the vertical corrugations being disposed in direct communication with a portion of the first and second concrete panels to receive a fluid bonding material.

9. The insulate sandwich construction unit of claim 8 wherein the fluid bonding material is selected from a group consisting of grout, mortar, and concrete.

10. The insulate sandwich construction unit of claim 8 wherein the corrugated sheet is cut from a larger pultruded sheet of resin impregnated glass fiber material.

11. The insulated sandwich construction unit of claim 1 wherein the structural connector is a composite material including a resin impregnated glass fiber material with in integral mesh base.

12. The insulate sandwich construction unit of claim 11 wherein the structural connector is a flat sheet, and wherein the attaching means includes a plurality of apertures formed near the first and second edges, the apertures being disposed in direct communication with a portion of the first and second concrete panels to receive a fluid bonding material.

13. The insulated sandwich construction unit of claim 12 wherein the flat sheet is cut from a larger pultruded sheet of resin impregnated glass fiber material with an integral mesh base.

14. The insulated sandwich construction unit of claim 11 wherein the structural connector is a corrugated sheet having vertically disposed corrugations formed near the first and second edges, the vertical corrugations being disposed to receive a fluid bonding material.

15. The insulated sandwich construction unit of claim 14 wherein the corrugated sheet is cut from a larger pultruded sheet of resin impregnated glass fiber material with an integral mesh base.

16. In an insulated sandwich construction unit, including a first panel disposed to extend between a floor member and a ceiling member, a second panel disposed in parallel spaced relationship to the first panel to extend between the floor and ceiling members, and insulating material disposed intermediate the first and second panels, the improvement comprising:

a continuous, one piece, vertical, load-transferring, structural connector formed of a rigid composite material including a resin impregnated glass fiber material with an integral mesh base having a low heat conductivity, the connector being disposed and extending the entire distance between the floor and ceiling structural members, the structural connector including a first edge attached to one end of the first panel and a second opposite edge attached to one end of the second panel; and means for attaching the first and second edges of the structural connector to the said one ends of the first and second panels.

17. The insulate sandwich construction unit of claim 16 wherein the structural connector is a flat sheet, and wherein the attaching means includes a plurality of apertures formed near the first and second edges, the apertures being disposed in direct communication with a portion of the first and second panels to receive a fluid bonding material.

18. The insulated sandwich construction unit of claim 17, wherein the flat sheet is cut from a larger pultruded sheet of resin impregnated glass fiber material with an integral mesh base.

19. The insulate sandwich construction unit of claim 16 wherein the structural connector is a corrugated sheet having vertically disposed corrugations formed near the first and second edges, the vertical corrugations being disposed to receive a fluid bonding material.

20. The insulated sandwich construction unit of claim 19 wherein the corrugated sheet is cut from a larger pultruded sheet of resin impregnated glass fiber material with an integral mesh base.

* * * * *